US008371899B1

(12) United States Patent
Walterscheid

(10) Patent No.: US 8,371,899 B1
(45) **Date of Patent: *Feb. 12, 2013**

(54) NOVELTY POP-UP TOY HAVING DOUBLE-LAYER BRAIDED SLEEVE BODY AND ITS ASSOCIATED METHOD OF MANUFACTURE

(76) Inventor: Steve Walterscheid, Bend, OR (US)

( * ) Notice: Subject to any disclaimer, the term of this patent is extended or adjusted under 35 U.S.C. 154(b) by 455 days.

This patent is subject to a terminal disclaimer.

(21) Appl. No.: 12/554,886

(22) Filed: Sep. 5, 2009

Related U.S. Application Data

(63) Continuation-in-part of application No. 11/605,074, filed on Nov. 28, 2006, now Pat. No. 7,806,746.

(51) Int. Cl.
*A63H 13/10* (2006.01)
*A63H 33/00* (2006.01)

(52) U.S. Cl. ..... 446/308; 446/486

(58) Field of Classification Search ..... 446/72, 446/308, 309, 311, 385, 486
See application file for complete search history.

(56) References Cited

U.S. PATENT DOCUMENTS

| | | | | |
|---|---|---|---|---|
| 1,657,936 | A * | 1/1928 | Nebel | 446/177 |
| 2,153,967 | A | 4/1939 | Lejeune at el | |
| 2,224,456 | A * | 12/1940 | Janas | 446/300 |
| 2,666,643 | A * | 1/1954 | Miller | 473/580 |
| 3,176,431 | A * | 4/1965 | Richardson et al. | 446/343 |
| 3,501,861 | A * | 3/1970 | Goldfarb et al. | 446/177 |
| 4,152,863 | A | 5/1979 | Kubiatowicz | |
| 4,219,959 | A * | 9/1980 | Fleischer | 446/486 |
| 6,315,687 | B1 * | 11/2001 | Todd et al. | 473/579 |
| 7,001,292 | B1 * | 2/2006 | Rappaport | 473/570 |
| 7,140,945 | B2 * | 11/2006 | Dinhofer | 446/378 |
| 7,806,746 | B2 * | 10/2010 | Walterscheid | 446/308 |

* cited by examiner

*Primary Examiner* — Gene Kim
*Assistant Examiner* — Alyssa Hylinski
(74) *Attorney, Agent, or Firm* — LaMorte & Associates, P.C.

(57) ABSTRACT

A novelty pop-up toy and its associated method of operation. The pop-up toy has a head section that is supported on a double-layered braided sleeve body. When the pop-up toy is compressed, the double-layered braided sleeve body elastically deforms from an uncompressed state to a compressed state. While in the compressed state, the double-layered braided sleeve body stores energy. If the compression force is suddenly released, the double-layered braided sleeve body releases its stored energy and pops back into its uncompressed state. As the double-layered braided sleeve body returns to its uncompressed state, it rapidly expands, therein providing enough force to propel the entire pop-up toy into the air.

12 Claims, 5 Drawing Sheets

NOVELTY POP-UP TOY HAVING DOUBLE-LAYER BRAIDED SLEEVE BODY AND ITS ASSOCIATED METHOD OF MANUFACTURE

RELATED APPLICATIONS

This application is a continuation-in-part of U.S. patent application Ser. No. 11/605,074, filed Nov. 28, 2006 now U.S. Pat. No. 7,806,746, entitled Novelty Device Having Braided Sleeve Body And Its Associated Method Of Operation.

BACKGROUND OF THE INVENTION

1. Field of the Invention

In general, the present invention relates to pop-up toys and similar novelty devices having resilient bodies that enable the toy to pop up after having been compressed. More particularly, the present invention relates to toys and novelty devices having components made from braided sleeves.

2. Description of the Prior Art

In the toy industry, a pop-up toy is the name commonly given to a class of toys that pop up after having been manually depressed. Such toys commonly have coil springs and suction cups. The spring is manually compressed until the suction cup can engage the surface under the toy. The compressed spring acts to free the suction cup. When the suction cup loses suction, the energy stored by the spring is released and the toy jumps or 'pops' up into the air. Such prior art pop-up toys are exemplified by U.S. Pat. No. 1,657,936 to Nebel, entitled Jumping Figure Toy, U.S. Pat. No. 7,140,945 to Dinhofer, entitled Gyrating Toy; and U.S. Pat. No. 2,224,456 to Janas, entitled Toy Doll.

In recent years, toy manufacturers have been becoming more concerned with product safety. Traditional pop-up toys that use compressed springs have certain inherent safety concerns. First, it is difficult to permanently attach a suction cup or a plastic novelty object to a metal spring. If a child pulls upon a traditional pop-up toy, as often happens, the spring detaches, therein exposing a sharp metal point. Furthermore, exposed metal springs have a tendency to pinch skin when compressed. Exposed metal springs also have a tendency to become entangled in a child's hair.

In the long history of toys, pop-up toys have been made that do not utilize metal springs. Such spring-free pop-up toys are typically made by forming a concave shape out of an elastic material. The concave shape is manually deformed into a convex structure, therein storing potential energy. At the moment the toy moves from its convex shape to its normal concave shape, energy is released and the toy pops into the air. Such non-spring pop-up toys are exemplified by U.S. Pat. No. 2,153,967 to Davis, entitled Jumping Toy and U.S. Pat. No. 4,152,863 to Kubiatowicz, entitled Popper Toy.

A problem associated with prior art spring-free pop-up toys is that it is very difficult to attach secondary objects, such as character heads, to the toy and still have the pop-up toy function correctly. A need therefore exists for a new structure for a pop-up toy that does not use metal springs, yet enables the popper device to be configured into a variety of novelty shapes. This need is met by the present invention as described and claimed below.

SUMMARY OF THE INVENTION

The present invention is a novelty pop-up toy and its associated methods of manufacture and operation. The pop-up toy has a head that is supported on a double-layered braided sleeve body. When the popper toy is compressed, the braided sleeve body elastically deforms from an uncompressed state to a compressed state. While in the compressed state, the braided sleeve body stores energy. If the compression force is suddenly released, the braided sleeve body releases its stored energy and pops back into its uncompressed state. As the braided sleeve body returns to its uncompressed state, it rapidly expands, therein providing enough force to propel the entire popper toy into the air.

The double-layered braided sleeve body is made by taking a single length of braided sleeve and invaginating the sleeve until its two cut ends are at the same position. This creates a double-layered body that is highly resilient and has no exposed cut edges that can fray.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention pop-up toy assembly can be configured in many different ways, only a simple embodiment is shown. The embodiment has been selected for ease of understanding and illustration. It should be understood that the selected embodiment is only exemplary and it should not be considered a limitation on the scope of the present invention as defined by the claims.

Figure 1:
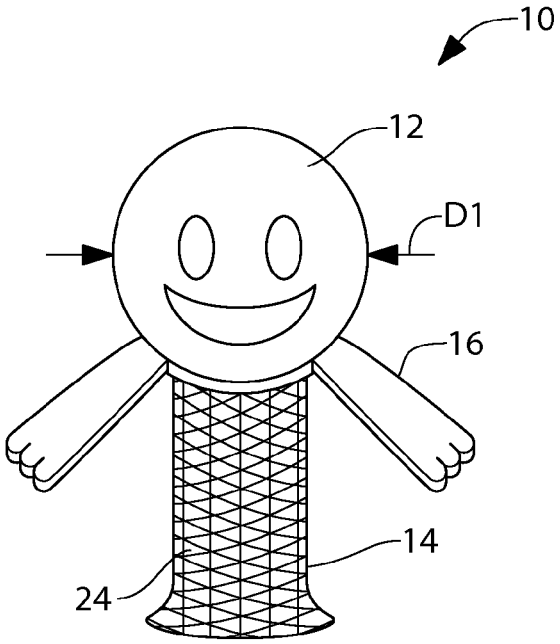
FIG. 1 is a front view of an exemplary embodiment of a popper toy assembly.
Figure 2:
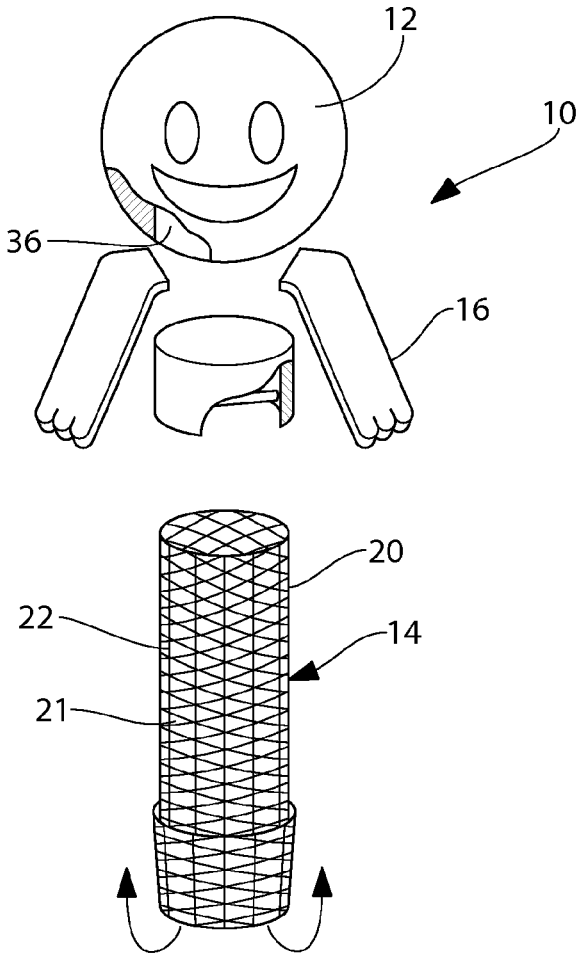
FIG. 2 is an exploded view of the embodiment of FIG. 1.

Referring to both FIG. 1 and FIG. 2, there is shown a pop-up toy assembly 10. The pop-up toy assembly 10 has a head 12, a braided sleeve body 14 and lateral extensions 16 that extend outwardly between the head 12 and the braided sleeve body 14. In the shown embodiment, the pop-up toy assembly 10 is configured as a novelty character. Accordingly, the head 12 is shaped as a character head with facial features and the lateral extensions 16 are shaped as arms.

The head 12 of the pop-up toy assembly 10 is preferably made from a polymer foam or another soft, lightweight material. As will be explained, the pop-up toy assembly 10 pops into the air. The use of a soft, lightweight material for the head 12 prevents the head 12 from causing any impact injuries as the toy assembly 10 flies. Furthermore, the use of soft, lightweight material enables the pop-up toy assembly 10 to pop up a significant distance into the air.

The head 12 is large in proportion to the remainder of the pop-up toy assembly 10. The head 12 has a maximum diameter D1, which prevents the head 12 from passing into the braided sleeve body 14 when the braided sleeve body 14 is compressed. The term "head" is intended to include any molded object that rests upon the braided sleeve body 14 and should not necessarily be considered only the head of a figure having facial figures. For example, if the pop-up toy assembly were configured as a rocket, the "head" may be considered the nose cone at the top of the rocket.

The lateral extensions 16 of the pop-up toy assembly 10 are optional. If provided, the lateral extensions 16 are made from a soft, lightweight material, such as felt or sheet foam.

The braided sleeve body 14 of the pop-up toy assembly 10 is primarily made from a partially invaginated length of braided sleeve 20. Braided sleeves are traditionally used in industry to protect the exterior of flexible cables. Braided sleeves are essentially tubes of interwoven plastic strands. The strands 21 that interweave in a helical pattern are called cross-over strands. The strands 22 that run straight along the length of a braided sleeve 20 are called warp strands. The cross-over strands 21 and warp strands 22 are interwoven, therein forming the braided sleeve 20. The resiliency of the braided sleeve 20 is determined by the resiliency and composition of the cross-over strands 21 and warp strands 22 in the weave. The braided sleeve 20 is porous and has interweave openings 24 that are generally less than one square millimeter each. As such, it is impossible for a child to insert a finger or another body part into the weave of the braided sleeve 20.

In the present invention pop-up assembly 10, the strands 21, 22 of the braided sleeve 20 are plastic. Accordingly, they can be manufactured in any selected color and embody a high degree of flexibility. The braided sleeve 20 is double-layered by being partially invaginated during the manufacture of the pop-up toy assembly 10.

Figure 3:
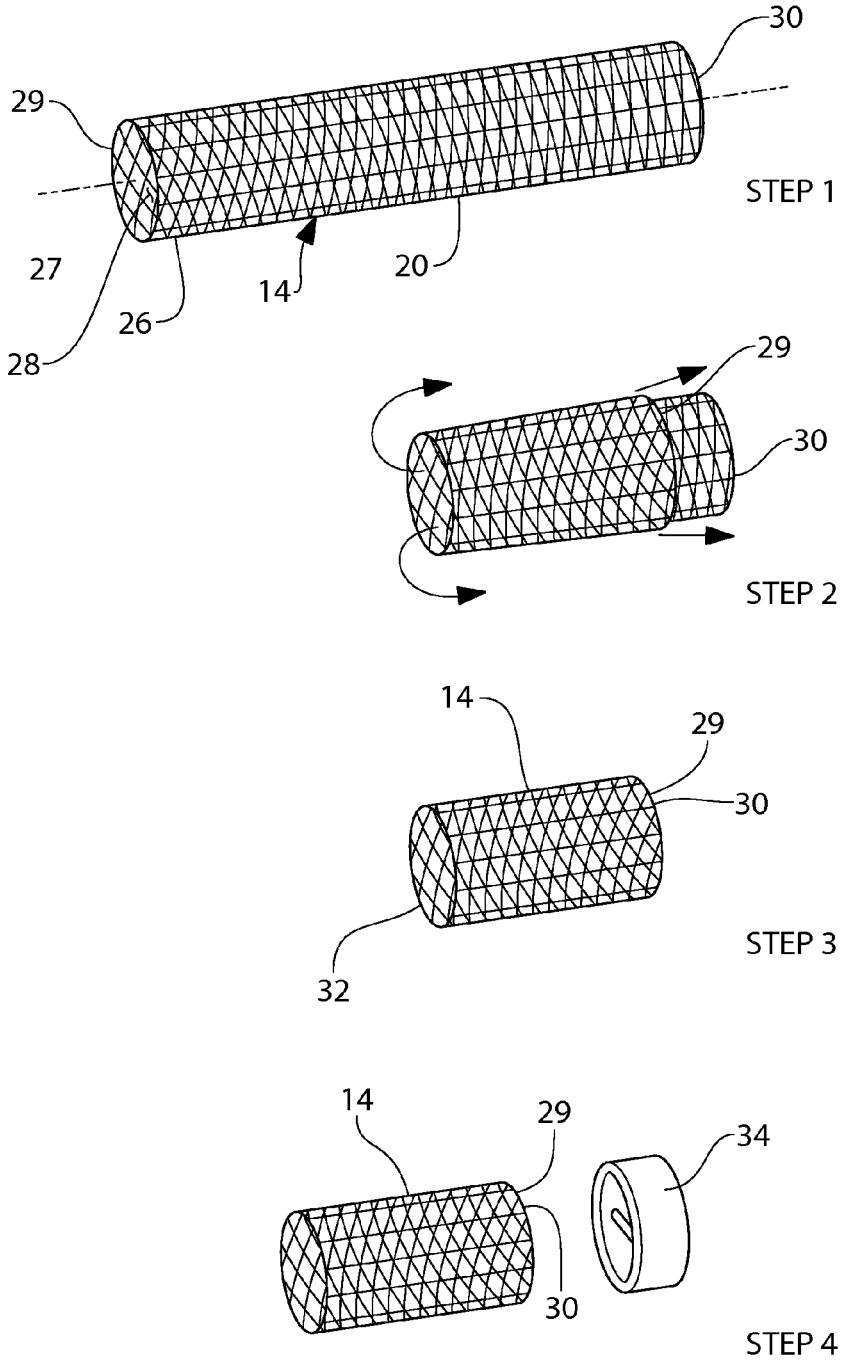
FIG. 3 is a schematic illustrating the steps used to form a double-layered braided sleeve body.

Referring to FIG. 3, the method of manufacturing the braided sleeve body 14 is illustrated. As is indicated by Step 1, a length of braided sleeve 20 is provided. The braided sleeve 20 is provided to manufacturers on large rolls from suppliers who weave the braided sleeve 20. The needed length of braided sleeve 20 is cut from a supply roll. Once a length of braided sleeve 20 is cut, the length of braided sleeve 20 defines a tubular structure 26 that is symmetrically disposed around a longitudinal axis 27. The tubular structure 26 defines a central opening that extends from a first end 29 to a second end 30. At both open ends 29, 30, the plastic strands 21, 22 that form the braided sleeve 20 terminate at cuts, and the interweaving will fray if not further processed.

As is indicated by Step 2 and Step 3, the first end of the braided sleeve 20 is inverted into the central opening 28. This invaginates the braided sleeve 20. The first end 29 of the braided sleeve 20 is advanced through the central opening 28 until the first end 29 of the braided sleeve 20 is even with the second end 30. This partial invagination creates a short braided sleeve body 14 that is double-layered. The two cut ends 29, 30 of the original braided sleeve 20 are now at one end of the braided sleeve body 14. The opposite end of the braided sleeve body 14 terminates with a smooth bend 32, having no frayed strands.

As is indicated by Step 4, the two cut open ends 29, 30 of the braided sleeve body 14 are terminated with an end cap 34. The end cap 34 is affixed to the material of the braided sleeve 20 with a pin, staple, adhesive or any other attachment means.

The end cap 34 has a small diameter that prevents the cut open ends 29, 30 of the braided sleeve 20 from expanding and fraying. The bend 32 at the center of the braided sleeve 20 expands slightly due to the properties of a braided sleeve. This provides the resulting braided sleeve body 14 with a slight frustum shape. Accordingly, the braided sleeve body 20 is wider at the bend 32 than anywhere else.

Returning to FIG. 2, it can be seen that a bore 36 is formed in the head 12 of the pop-up toy assembly 10. The bore 36 is sized and shaped to receive the end cap 34 that terminates the free ends 29, 30 of the braided sleeve body 14. The end cap 34 may be inserted into the bore 36 with a friction fit. However, it is preferred that the end cap 34 be set into the bore 36 with a small amount of adhesive.

Figure 4:
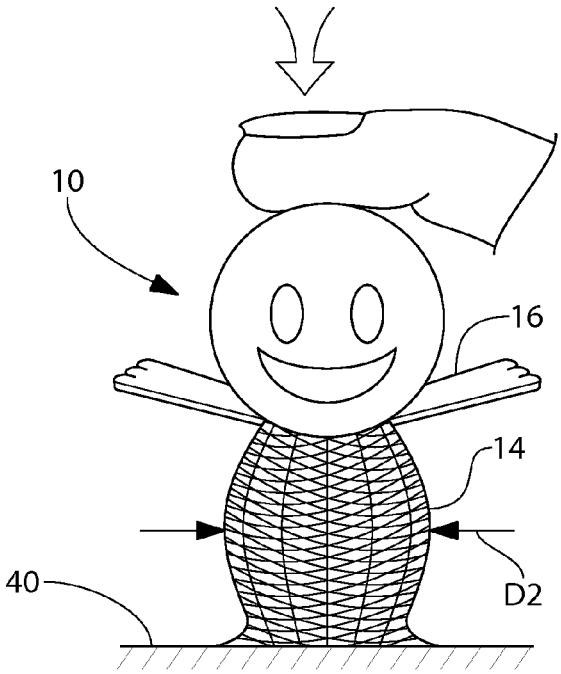
FIG. 4 shows the exemplary embodiment of FIG. 1 in a compressed state.

Referring to FIG. 4, it can be seen that when the braided sleeve body 14 is compressed along its length, the braided sleeve body 14 shortens and widens. The braided sleeve body 14 widens to a maximum width D2, which is preferably smaller than the maximum width D1 of the head 12. As a braided sleeve body 14 shortens and widens, it stores energy. As soon as the compression force is removed, the braided sleeve body 14 will spring back into its uncompressed shape, therein releasing the stored energy.

In order to operate the pop-up toy assembly 10, the wide bottom of the pop-up toy assembly 10 is placed on a flat surface 40. A compression force is applied downwardly to the head 12 of the pop-up toy assembly 10. As the compression force builds, the double-layered braided sleeve body 14 shortens and expands, therein storing energy. The lateral extensions 16 that extend below the head 12 help prevent the head 12 from passing into the structure of the braided sleeve body 14 as the braided sleeve body 14 shortens and expands. However, if the head 12 is made wider than the expanded width of the braided sleeve body 14, the head 12 cannot pass into the braided sleeve body 14, thereby preserving the operating configuration of the pop-up toy assembly 10.

Figure 5:
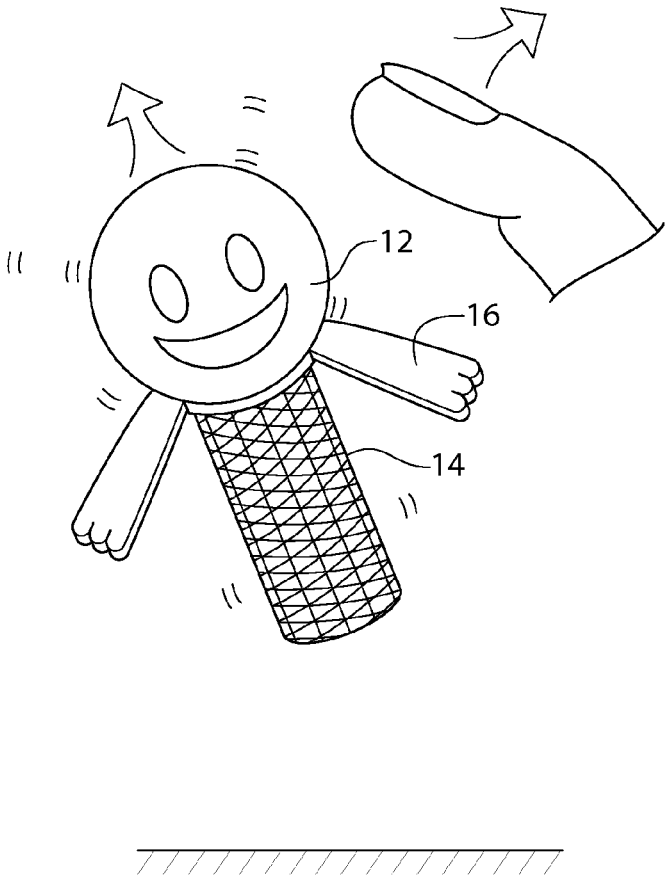
FIG. 5 shows the embodiment of FIG. 4 immediately after a compression force is removed.

Referring to FIG. 5, it can be seen that once the compression force is released, the braided sleeve body 14 rapidly returns to its original shape. This drives the head 12 and the lateral extensions 16 upwardly with enough force to cause the pop-up toy assembly 10 to snap back to its uncompressed shape and fly away from the flat surface 40.

It will be understood that the embodiment of the present invention that is illustrated and described is merely exemplary and that a person skilled in the art can make many changes to the shown embodiment without departing from the intended scope of the invention. For instance, in the illustrated embodiment, the pop-up toy assembly is shown as a figure having a simple round head and arm extensions. It should be understood that the pop-up toy assembly can have many other shapes, such as a rocket ship, mushroom, or flower. Thus, the pop-up toy assembly can be shaped as a character or any other object as a matter of design choice. All such variations, modifications, and alternate embodiments are intended to be included within the scope of the present invention as defined by the claims.

What is claimed is:

1. A method of operating a pop-up toy comprising the steps of:

providing a toy structure having a head, and a length of braided sleeve made from interwoven plastic strands, wherein said braided sleeve has a first end and a second end, and wherein said length of braided sleeve is invaginated so that both said first end and said second end are anchored to said head and form a free bottom end opposite said head;

compressing said braided sleeve by placing said free bottom end of said braided sleeve against a surface and applying a compression force to said head to compress said braided sleeve by moving said head toward said bottom end, therein altering said braided sleeve from an uncompressed state to a compressed state; and removing said compression force when said braided sleeve is in said compressed state, therein causing said braided sleeve to expand into said uncompressed state with enough force to propel said toy into the air.

2. The method according to claim 1, further including the step of terminating said first end and said second end in a common end cap.

3. The method according to claim 2, wherein a bore is formed in said head and said end cap is inserted into said bore.

4. The method according to claim 1, wherein lateral extensions extend from between said head and said braided sleeve an inhibit said head from pressing into said braided sleeve when in said compressed state.

5. The method according to claim 1, wherein said head is a molded plastic foam head.

6. The method according to claim 5, wherein said head is a character head having facial features.

7. A method of forming a pop-up toy comprising the steps of:

providing a length of braided sleeve made from interwoven plastic strands, wherein said braided sleeve defines a central opening that extends between an open first end and an open second end;

forming a resilient body by partially inverting said braided sleeve;

providing an end cap, wherein said open first end and said open second end enter said end cap and are adhesively anchored within said end cap;

providing a head made of foam material, wherein a bore is formed within said head;

providing a plurality of lateral projections that extend outwardly between said head and said braided sleeve; and anchoring said end cap within said bore, therein connecting said resilient body to said head so that said resilient body supports said head atop said resilient body and wherein said plurality of lateral projections extend below said head and help prevent the head from passing into said resilient body when said resilient body is compressed under said head.

8. The method according to claim 7, wherein said step of providing a head includes providing a molded plastic foam head.

9. The method according to claim 7, wherein said step of providing a head includes providing a character head having facial features.

10. A method of operating a pop-up toy, comprising the steps of:

providing a toy comprised in part of a length of double-layered braided sleeve;

compressing said toy by applying a compression force to said toy to compress said braided sleeve, therein altering said braided sleeve from an uncompressed state to a compressed state;

removing said compression force when said braided sleeve is in said compressed state, therein causing said braided sleeve to expand into said uncompressed state with enough force to propel said toy into flight.

11. The method according to claim 10, wherein said step of providing a toy comprised in part of a length of double-layered braided sleeve includes providing a toy having a head that is coupled to a partially invaginated length of braided sleeve.

12. The method according to claim 10, wherein said head is a character head having facial features.

* * * * *